United States Patent [19]

Köbler

[11] Patent Number: 4,856,425

[45] Date of Patent: Aug. 15, 1989

[54] ADJUSTABLE BEARING ARRANGEMENT FOR A PRINTING MACHINE CYLINDER

[75] Inventor: Ingo Köbler, Anhausen, Fed. Rep. of Germany

[73] Assignee: M.A.N. Roland Druckmaschinen AG, Offenbach-am-Main, Fed. Rep. of Germany

[21] Appl. No.: 186,797

[22] Filed: Apr. 27, 1988

[30] Foreign Application Priority Data

May 9, 1987 [DE] Fed. Rep. of Germany ..... 3715536

[51] Int. Cl.[4] ..... B41F 13/20

[52] U.S. Cl. ..... 101/212; 101/216; 101/153; 101/382.1; 384/99; 279/110

[58] Field of Search ..... 101/212, 216, 247, 375, 101/376, 218, 153, 382.1, 183, 184, 219; 384/99, 247, 255, 447, 519; 279/110, 71, 1 J, 1 TE, 6

[56] References Cited

U.S. PATENT DOCUMENTS

| | | | |
|---|---|---|---|
| 913,119 | 2/1909 | Ford | 101/218 |
| 1,797,541 | 3/1931 | Borden | 279/110 |
| 1,853,255 | 4/1932 | Borden | 279/110 |
| 2,118,965 | 5/1938 | Büttner | 101/247 |
| 2,929,572 | 3/1960 | Baumgartner et al. | 384/255 |
| 2,961,277 | 11/1960 | Sternlicht | 384/99 |
| 3,633,503 | 1/1972 | Tafel | 101/218 |
| 3,679,272 | 7/1972 | Costa et al. | 384/99 |
| 3,986,454 | 10/1976 | Granger | 101/247 |
| 4,395,140 | 7/1983 | Sable | 384/99 |
| 4,453,464 | 6/1984 | Weis | 101/216 |

FOREIGN PATENT DOCUMENTS

| | | | |
|---|---|---|---|
| 470937 | 2/1929 | Fed. Rep. of Germany | 101/375 |
| 490994 | 2/1930 | Fed. Rep. of Germany . | |
| 1974399 | 12/1967 | Fed. Rep. of Germany . | |
| 2636555 | 5/1977 | Fed. Rep. of Germany . | |
| 3318316 | 12/1983 | Fed. Rep. of Germany | 101/247 |
| 3324811 | 1/1985 | Fed. Rep. of Germany | 101/216 |
| 3500319 | 6/1986 | Fed. Rep. of Germany . | |
| 1449490 | 8/1966 | France . | |

*Primary Examiner*—Edgar S. Burr
*Assistant Examiner*—Kimberly L. Asher
*Attorney, Agent, or Firm*—Frishauf, Holtz, Goodman & Woodward

[57] ABSTRACT

To permit re-lining of a printing machine cylinder (9), while retaining the printing machine cylinder in adjusted position with respect to a reference, for example an associated cylinder, the side wall (1) of the printing machine is formed with an opening (2) sufficiently large to permit placing of a sleeve (14) over the cylinder. The cylinder shaft (8) is retained, prior to re-lining, in eccentric adjustment by a jaw chuck (3), preferably having three jaws (16, 17, 18) arranged in a star pattern and surrounding the shaft or the bearing, or an eccentric element thereof; the jaws of the jaw chuck are so placed that they can be withdrawn to clear the opening. To determine a previously adjusted position of the jaws of the jaw chuck, and thus a predetermined position of the cylinder with respect to the reference, after withdrawal of the jaw chucks, stop elements (10; 22, 23, 24) are associated with the jaw chucks so that, upon gripping the bearing (7) of the printing cylinder after a prior withdrawal, a previously adjusted position of the cylinder (9) will be reestablished.

14 Claims, 1 Drawing Sheet

FIG.1
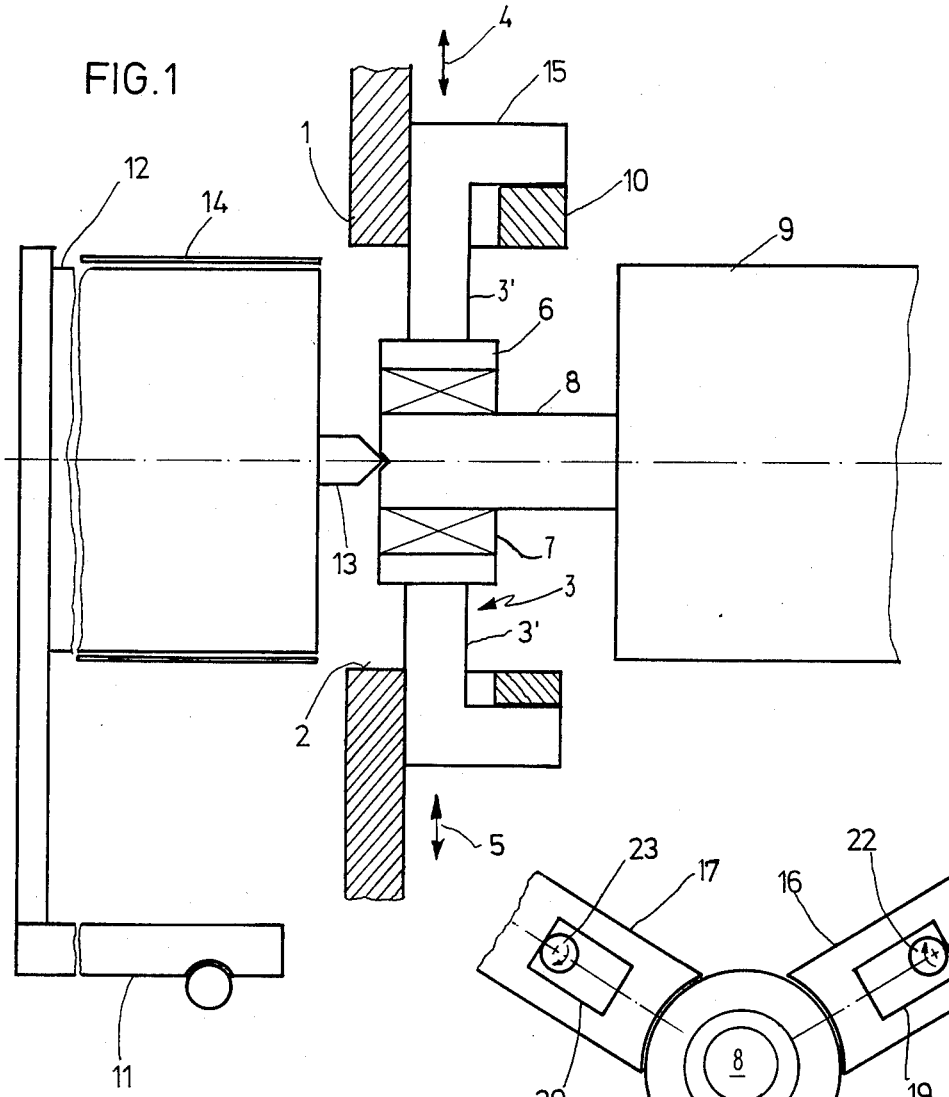
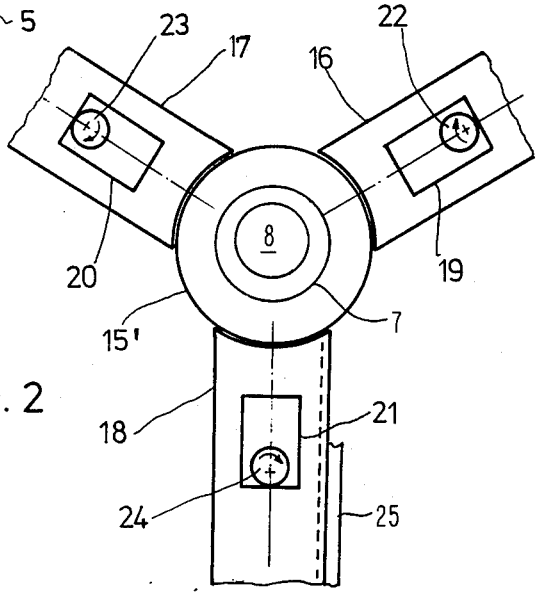
FIG. 2

ADJUSTABLE BEARING ARRANGEMENT FOR A PRINTING MACHINE CYLINDER

BACKGROUND

It is known to form a printing machine with a side wall with a sufficiently large opening to permit a re-lining apparatus to introduce a cover liner or the like over a printing machine cylinder through the opening in the side wall of the machine. German Pat. No. 470,937 describes an arrangement in which a support which retains an axial bearing for a printing cylinder can be dropped in the plane of the side wall of the printing machine after, previously, an auxiliary apparatus has gripped the stub shaft of the cylinder. This arrangement then permits feeding of a sleeve through an opening in the side wall of the printing machine over the shaft bearing. The arrangement is specifically provided for gravure printing machines. After the liner is placed on the cylinder, the carrier for the bearing is raised against the bearing, and the auxiliary apparatus then is removed.

Gravure printing cylinders, as well known, are retained in side walls of the printing machine in a fixed position, that is, they are not retained such that the axial position of the bearings can be shifted or moved. The referenced German Pat. 470,937 does not disclose anything with respect to possibly re-positioning the axial shaft position of the cylinder, and also of the bearing therefor.

Various types of printing machines, such s offset printing machines, have cylinders in which the axial position thereof is adjustable, for example by permitting selective engagement of a respective cylinder against another cylinder in the printing machine system. If it is desired to apply sleeves or cover jackets on printing machine cylinders which are adjustably located in the side walls, for example, and as is customary, within bearings which are eccentrically positionable, then the arrangement of the prior art cannot be used to ensure appropriate positioning of the cylinder after re-lining, for example.

THE INVENTION

It is an object to provide a printing machine system in which the bearing arrangement for a printing machine cylinder is so arranged that it can be adjustably positioned, removed, re-lined, and, after re-lining, will retain the same adjusted position as it had before. Usually, the bearings are eccentrically arranged.

Briefly, the bearing is held in a jaw chuck, retained on the side wall of the machine. The jaw chuck is slidable along the side wall and grips the bearing. Adjustable stop means are provided, operatively associated with the jaw chuck and determining the holding position of the bearing in the jaw chuck.

The arrangement has the advantage that the position of a cylinder, as determined by the adjustment of the jaw chucks retaining the bearing, can be set by stop elements. After opening of the jaw chuck, to permit access to the cylinder for relining, for example, and subsequent re-closing, the jaw chucks can be re-closed against the previously set stops so that the position of the cylinder, for example with respect to another cylinder, will be retained. The invention is applicable to all types of printing cylinders, but particularly to forme and/or blanket cylinders such as rubber cylinders, for use in raisedletter, flexo or offset printing machines.

The side wall is formed with an opening sufficiently large to permit a sleeve to be slid therethrough and over the cylinder. The jaw chuck and stop arrangement then ensures that, after removal of a prior jacket or sleeve from the cylinder, and re-lining of the cylinder, or merely after placement of a new sleeve or jacket over the cylinder, the spacing of the respective cylinder in relation to an adjacent cylinder will not be changed.

DRAWINGS

Illustrating an exemplary embodiment:

FIG. 1 is a side view, partly in section, of the arrangement in accordance with the present invention; and FIG. 2 is a schematic illustration of eccenter adjustment with three jaw chucks.

DETAILED DESCRIPTION.

The bearing holding arrangement in accordance with the present invention need be applied only on one side wall of the machine. FIG. 1 illustrates, schematically and in fragmentary representation, a side wall 1 of a printing machine which is formed with an opening 2, of sufficient dimension to permit placement of a sleeve or jacket 14 over a printing machine cylinder 9. The bearing for the printing machine cylinder 9 at the right side—with respect to FIG. 1—and not shown, can be a standard bearing of well known construction and need not incorporate the subject matter of the present invention.

In accordance with the present invention, a jaw chuck 3 is located against a surface of the side wall 1 of the printing machine, preferably against the inner surface thereof. The jaws 3' of the jaw chuck 3 are slidable in the direction of the arrows 4, 5. The jaws 3' of the jaw chuck 3 grip a bushing 6 within which a bearing 7 is located, receiving a stub shaft 8 coupled to the cylinder 9.

In accordance with a feature of the invention, the position of the jaws 3' of the jaw chuck 3 can be predetermined, for example by being adjustable and limited in their movement, so that the position of the printing machine cylinder 9 with respect to a reference, for example another printing cylinder, can also be adjusted. Stops 10 are provided, coupled in any suitable manner to the side wall 1, and adjustable with respect to the jaws of the jaw chuck 3 to predetermine their position. The stops 10, preferably, are eccentric elements retained directly on the side wall 1 of the printing machine, and rotatable about an eccentric shaft. By turning such eccentrically retained stops 10, the position of the jaws of the jaw chuck 3 can then determine the position of the cylinder 9 with respect to the reference, for example in relation to an associated or adjacent printing machine cylinder.

The jaws of the jaw chuck 3 can be essentially L-shaped. The angled-off arms 15 can engage the stops, or eccentrics 10, respectively.

LINING OF CYLINDER 9

A movable auxiliary apparatus 11 is moved adjacent the side wall 1 of the printing machine. The movable auxiliary apparatus 11 has a cylindrical carrier 12 thereon with a projecting holder 13. The sleeve to be applied on the cylinder 9 is retained on the carrier 12. The projection 13 is engaged with an end recess of the stub shaft 8 of the cylinder 9, to support the cylinder 9 during the sleeving operation.

Upon support of the cylinder 9 by the projection 13, the jaws of the jaw chuck 3 can be spread apart so that the sleeve 14 on the carrier 12 can be pushed through the opening 2 in the side wall of the printing machine, and applied on the printing machine cylinder 9. When the sleeve 14 is seated on the cylinder 9, the jaws of the jaw chuck 3 can be placed, again, in the position shown in FIG. 1 to grip the sleeve 6 and hence the bearing 7. The previously adjusted position of the jaws will be retained since the jaws can be moved only until engagement with the stop elements 10. Thus, the position of the cylinder 9 does not change with respect to a prior position, since the bushing 6 has been retained in the previous position. The position of the cylinder 9 remains as before, during sleeve removal and/or application of the new sleeve 14. The stop elements or eccentrics 10 are not affected by removal of an old sleeve from the cylinder 9 and/or placement of a new sleeve 14 thereover.

The sleeve 14 may be of any suitable or desired form, for example carry a rubber coating if the printing machine cylinder 9 is an offset cylinder; the sleeve 14 may,-however, also have a surface which carries printed subject matter, for example a metallic surface if the printing cylinder 9 is a forme cylinder.

Another, and preferred arrangement for adjusting the position of the bearing 7, and for retaining it in adjusted position, while permitting withdrawal of the jaw chuck, is shown in FIG. 2. A bearing 15', corresponding for example to the bushing 6 of FIG. 1, is held in position by a jaw chuck having jaws 16, 17, 18 slidable on side walls 1. A triple-jaw star arrangement with jaws 120° apart is preferred. The jaw chucks 16, 17, 18 are formed with elongated openings 19, 20, 21 which, each, retain an eccentric 22, 23, 24, and forming adjustable stops like stops 10 of FIG. 1. Eccentrics 22–24 are rotatably attached to the side wall 1 (not shown in FIG. 2). The jaws 16, 17, 18 can be slid radially inwardly and outwardly, for example by coupling to a power piston-cylinder arrangement, operated pneumatically or hydraulically. By selective and specific energization of jaw moving elements coupled to the jaws 16, 17, 18, and selective control thereof, the respective position of the bushing 15' can be determined upon engagement of the end of the openings 19–21 with the respective eccentrically mounted stops 22–24 therein (FIG. 2). Hydraulic or other fluid cylinder-piston arrangements coupled to the jaws 16-18 can then be used at the same time to spread apart the jaws of the jaw chucks to permit placement of a sleeve 14 through the opening 2 of the side wall 1. The jaws 16, 17, 18 or the entire jaw chucking arrangement can be guided in suitable guide tracks, shown for example by a strip 25 engaging in a dovetail groove formed in the side of the respective jaw. Only a fragmentary portion of such a guide arrangement is shown since it can be in accordance with any well known and standard engineering practice.

Various changes and modifications may be made within the scope of the invention concept.

I claim:

1. A rotary printing machine having a side wall (1);

a printing cylinder (9) adapted to receive a sleeve thereon and a cylinder shaft (8) extending from the printing cylinder;

a bearing (7) rotatably retaining said cylinder shaft;

a bearing bushing (6; 15') surrounding the bearing;

a jaw chuck (3) having jaws (3'; 16–18) retained on the side wall (1) for radial sliding movement thereon relative to the cylinder shaft, and positioned for selectively gripping and releasing the bearing bushing (6; 15');

the side wall of the printing machine being formed with an opening (2) of sufficient size to permit a sleeve (14) to pass through the side wall (1) and be fitted over the printing cylinder (9);

means for withdrawing said jaws of said jaw chuck to permit placement of a sleeve on said cylinder;

means for supporting and reliably maintaining the position of the free end of the cylinder shaft while said jaws are withdrawn;

and means for permitting said jaws to be held in a holding position and to maintain said bearing bushing and hence said shaft in a desired position, and to enable said jaws to be quickly and reliably returned to said holding position after having been withdrawn from said bearing bushing;

said means for permitting said jaws to maintain and be quickly and reliably returned to said holding position comprising adjustable stop means (10; 22–24) operatively associated with the jaws of said jaw chuck and said bearing bushing, and abutment means formed on the jaws, wherein said adjustable stop means are set and said jaws and hence said abutment means can be slid in and out of engagement with said stop means such that when the jaws grip the bearing bushing, the stop and adjustment means are engaged, and when the jaws are withdrawn, the stop and abutment means are released.

2. The machine of claim 1, wherein said adjustable stop means comprise rotatable eccentric elements (10; 22, 23, 24).

3. The machine of claim 1, wherein the jaw chuck (3) comprises at least two essentially L-shaped jaws (3') having an arm extending parallel to the side wall (1) and a projecting arm (15);

and wherein said stop means and said projecting arm (15) are in mutual engagement.

4. The machine of claim 3, wherein said stop means comprise rotatable eccentrics (10; 22, 23, 24).

5. The machine of claim 1, including auxiliary apparatus (11) comprising a cylindrical carrier (12) retaining said sleeve (14) thereon.

6. The machine of claim 5, wherein the auxiliary apparatus is movable towards and away from the free end of the cylinder shaft (8).

7. The machine of claim 1, wherein the jaw chuck comprises a plurality of jaws (3'; 16, 17, 18) for, conjointly, determing the position of the center of the cylinder shaft (8);

and wherein said stop means comprise stop elements (10; 22, 23, 24) individually associated with each jaw.

8. The machine of claim 7, wherein three jaws (16, 17, 18) are provided, said three jaws arranged 120° apart is a star formation, and engageable, when drawn together, for rotatably supporting the cylinder shaft (8);

and wherein said stop elements comprise individual eccentrics (22, 23, 24) associated with each of said jaws.

9. The machine of claim 2, including auxiliary apparatus (11) comprising a cylindrical carrier (12) retaining said sleeve (14) thereon.

10. The machine of claim 9, wherein the auxiliary apparatus is movable towards and away from the free end of the cylinder shaft (8).

11. The machine of claim 3, including auxiliary apparatus (11) comprising a cylindrical carrier (12) retaining said sleeve (14) thereon.

12. The machine of claim 11, wherein the auxiliary apparatus is movable towards and away from the free end of the cylinder shaft (8).

13. The machine of claim 8, including auxiliary apparatus (11) comprising a cylindrical carrier (12) retaining said sleeve (14) thereon.

14. The machine of claim 13, wherein the auxiliary apparatus is movable towards and away from the free end of the cylinder shaft (8).

* * * * *